US006083113A

United States Patent [19]

Bernhardt

[11] Patent Number: 6,083,113

[45] Date of Patent: Jul. 4, 2000

[54] GOLF PUTTER

[75] Inventor: Mark A. Bernhardt, Indianapolis, Ind.

[73] Assignee: Positive Putter Company, Inc., Indianapolis, Ind.

[21] Appl. No.: 09/070,463

[22] Filed: Apr. 30, 1998

[51] Int. Cl.[7] ..... A63B 53/02; A63B 53/04

[52] U.S. Cl. ..... 473/131; 473/313; 473/409; 473/314; 73/65.03

[58] Field of Search ..... 473/313, 314, 473/340, 409, 219, 316, 251, 131; 73/65.03

[56] References Cited

U.S. PATENT DOCUMENTS

| | | |
|---|---|---|
| D. 212,890 | 12/1968 | Rose . |
| D. 240,249 | 6/1976 | Chellman . |
| 2,820,638 | 1/1958 | Morrison . |
| 3,497,220 | 2/1970 | Scott . |
| 3,954,265 | 5/1976 | Taylor . |
| 4,163,554 | 8/1979 | Bernhardt . |
| 4,325,550 | 4/1982 | Thompson . |
| 4,871,174 | 10/1989 | Kobayashi . |
| 5,226,654 | 7/1993 | Solheim . |
| 5,228,332 | 7/1993 | Bernhardt . |
| 5,755,625 | 5/1998 | Jackson . |
| 5,827,130 | 10/1998 | Jimenez . |

*Primary Examiner*—Sebastiano Passaniti
*Attorney, Agent, or Firm*—Woodard, Emhardt, Naughton, Moriarty & McNett, Patent and Trademark Attorneys

[57] ABSTRACT

A method of manufacturing a golf putter with a true balance includes the steps of designing or selecting a particular shape and style of putter head and then providing a putter shaft with a longitudinal axis and a neck portion which is integral with the shaft. With the putter head defined, the front-to-rear and toe-to-heel center of gravity cutting planes are accurately deterrnined. The point of attachment for the shaft into the top surface of the putter head via the neck portion is then selected and a plurality of bends in the neck are derived and made so that the longitudinal axis of the shaft passes through the front-to-rear center of gravity cutting plane. The intersection location on the top surface is between the toe of the putter head and the toe-to-heel center of gravity cutting plane. Once the shaft is joined to the head via the neck portion with a slow-setting adhesive, the putter is set on a flat, horizontal surface in order to test to see if there is any turning or rotation. If there is some slight turning or rotation of the putter head, a fine adjustment is made by rotating the shaft and neck portion relative to the head until a true balance is achieved.

16 Claims, 4 Drawing Sheets

GOLF PUTTER

BACKGROUND OF THE INVENTION

The present invention relates in general to the design of golf clubs and in particular to the design of putters and a manufacturing method to insure that a true balance is achieved notwithstanding minor tolerance variations which typically occur during the manufacturing process.

The designs of golf clubs over the years have focused on numerous concepts which were believed to provide longer shots, more accurate shots, better control, better feel, more power and so forth. Quite often the design changes have involved a change of materials. Wooden shafts have given way to metal and now graphite. The heads of the woods and irons have undergone material changes as well as weight-distribution and shaping changes. These design evolutions have not been limited to the woods and irons, putters have seen as much if not more changes in their shapes and design theories over the years as any of the other clubs. One possible explanation for the extensive activity in the design of golf putters is the significance of this particular club relative to the other clubs when one considers the stroke count in a typical par round of golf. While the driver will typically be used 14 times and a 3-wood 4 or 5 times, other clubs such as the various irons may only be used a maximum of 4 or 5 times in any one round of golf. The putter, on the other hand, is used at least 24 times and more likely 36 times (or more), assuming that for a par round the golfer reaches each green in regulation and is able to two-putt each green.

While the design change activities for golf have been directed to literally all phases of the game, including golf balls, not all design changes are good for all players because of physical differences and styles. Due to anatomical differences in players and the dynamics of their style of play, certain changes which have been made to the woods and irons are not well suited to every player. Consequently, numerous changes and variations have been offered by literally every manufacturer in an attempt to find a particular combination of features and design style which a large number of players like and hopefully prefer. The problem is that there is no common denominator as to a feature or features which everyone agrees is an absolute necessity. Some players still prefer metal shafts over graphite and some players still prefer laminated wood over metal heads for the driver and 2–5 "woods". The reason these players prefer the "older" design style is that they play better with these styles. Most golfers are not so vain as to stick with a wood or iron style for sentimental reasons if it is adversely affecting their play. Golfers, like most other sportsmen, continually look for the newest or latest development in hopes that the design changes will improve their game not only for a lower score but as well for the satisfaction of a well-struck shot and the enjoyment which that gives to a golfer. The level of play is all that matters to professional golfers, and thus if there was clearly a superior design style everyone would go to that style and yet, as we know, this has not occurred.

While there is no common denominator for an essential design feature for woods or irons outside of the basics of a shaft and head and the necessary size and weight, there is a key or critical ingredient to the design of the best golf putter, and this ingredient is for the putter to possess a true balance. A putter's performance does not improve by the use of space age manufacturing techniques directed to shaping the head or extruding the shaft, etc. What really matters in the design of a golf putter is its balance. Only with a near-perfect or true balance can the golfer's success be controlled solely bv the golfer's abilities. If a highly skilled golfer uses a putter which is not properly balanced, the putter will react by tending to turn or shift and while the golfer can manually override this tendency, it does influence the golfer's control, swing, and aim. In other words, can the golfer determine how much to alter or compensate an otherwise true swing or stroke in order to take into consideration the inherent turn or shift in the putter which results when the putter is not properly balanced?

If one looks at those putters with odd-looking, peculiar shapes, it should be clear that what the designer is trying to do is use shaping and weighting theories to try and achieve a true or perfect balance. In some instances, the shaping and styling of the putter is done with the objective of enhancing the golfer's aim, feeling that if the golfer is able to maintain the putter in a particular direction during the swing, assuming that direction has been predetermined as a proper direction, then the resultant stroke will be somewhat more accurate. The problem though persists in that as the golfer swings the putter, if the putter is not properly balanced, it will tend to turn or pivot in the golfer's hands and the golfer must adjust and compensate for this tendency. Numerous attempts have been made to try and guarantee the golfer a true and accurate swing, but how can this be done if the putter has a tendency to rotate or turn during a free swing such that the ball-striking face is not properly oriented at the point of contact?. One problem in the past is that different manufacturers have different theories as to balance and while some degree of balance might exist in one plane or orientation for the putter, the dynamic balance of the putter swing has been ignored.

In U.S. Pat. No. 4,866,979, which issued Sep. 19, 1989 to Bernhardt, an apparatus is disclosed which is designed to reveal the true balance of golf putters as they swing in a manner which accurately simulates a putter stroke. The putter under examination is installed into a holder which is set at an inclined angle and pivotally attached to an upright support. As the putter is drawn up and away, and then released and swings, if true balance does not exist the putter will turn or rotate in the holder, thereby revealing the fact that the putter is not balanced in the only mode of balance that really matters, namely dynamic balance during the swing or stroke motion.

This balance-revealing device for golf putters has been successfully used by pro shops and by companies in order to compare the balance of various putters. Various putters which the designer, manufacturer, or user may have claimed to be balanced have been shown to be unbalanced by this apparatus. This unbalanced condition is disclosed during the simulated putter stroke by the putter actually turning in the apparatus as is fully described in U.S. Pat. No. 4,866,979. What happens is that at the point of contact with the ball, the putter head is oriented in a totally unacceptable position and use of this invention allows one to compare the degree of balance of various competing putters.

Since achieving a true balance for golf putters is important regardless of personal preferences in the size and shape of the putter head and regardless of the stroke style, it is important to be able to control the balance during the manufacturing process. While the balance-revealing apparatus invention will tell when the manufacturing process has failed, it is then too late. Further, even a precisely dimensioned and styled putter can encounter minor variations in weight distribution due to casting tolerances, porosity, etc. which will throw off the anticipated balance or center of gravity.

In order to try and achieve a true balance golf putter, a manufacturing method has been conceived wherein various geometric cutting planes are used to divide the putter head. This invention is disclosed in U.S. Pat. No. 5,228,332 which issued Jul. 20, 1993 to Bernhardt. In this invention one cutting plane divides the head through the center of gravity between the top and bottom. Another cutting plane divides the putter head through the center of gravity between the heel and toe. The final cutting plane divides the head through the center of gravity between the front surface and rear surface of the putter head. In the '332 patent, the point of attachment of the shaft neck is centered on the cutting plane dividing the head between the front and rear surfaces. With this point of attachment, the axis of the shaft is directed so as to extend along the front to rear cutting plane and pass near the overall center of gravity, but not through the overall center of gravity.

According to the present invention it has been learned that it is not necessary to center the point of attachment for the shaft neck on the geometric cutting plane which extends through the front-to-rear center of gravity. Proper alignment and balance can still be achieved by being prepared to bend the shaft neck at one or two spaced-apart locations in order to orient the longitudinal shaft axis so as to extend in the desired direction. The desired direction is a direction which passes beside the overall center of gravity and is spaced from the overall center of gravity by a designed dimension (i.e., distance 42 in the '332 patent).

The present invention also discloses a manufacturing method similar to that of the '332 patent which enables one to adjust the relationship of the head and shaft in order to compensate for minor tolerance and weight distribution variations which, if left alone, would create an unbalanced putter. In the manufacture of golf putters, once the shaft is rigidly fixed to the putter head, precise adjustments cannot be made in any realistic fashion or manner.

SUMMARY OF THE INVENTION

A method of manufacturing a golf putter with a true balance according to one embodiment of the present invention comprises providing a golf putter head having a top surface, a toe and a heel and a desired size and shape, providing a golf putter shaft having a longitudinal axis, providing a neck portion, attaching the neck portion to the shaft, determining front-to-rear and toe-to-heel center of gravity planes for the golf putter head, selecting an attachment location for the neck portion to the golf putter head which is spaced apart from the front-to-rear center of gravity plane, bending the neck portion relative to the attachment location such that the longitudinal axis extends to intersect the front-to-rear center of gravity plane at a location on the top surface between the toe-to-heel center of gravity plane and the toe of the golf putter head, attaching the neck portion to the golf putter head, and adjusting the golf putter head and the golf putter shaft relative to each other by rotating the neck portion within the putter head based upon the balance determined by placing the golf putter on a flat, horizontal surface.

One object of the present invention is to provide an improved method of manufacturing a golf putter in order to achieve a true balance.

Related objects and advantages of the present invention will be apparent from the following description.

DESCRIPTION OF THE PREFERRED EMBODIMENT

Figure 1:
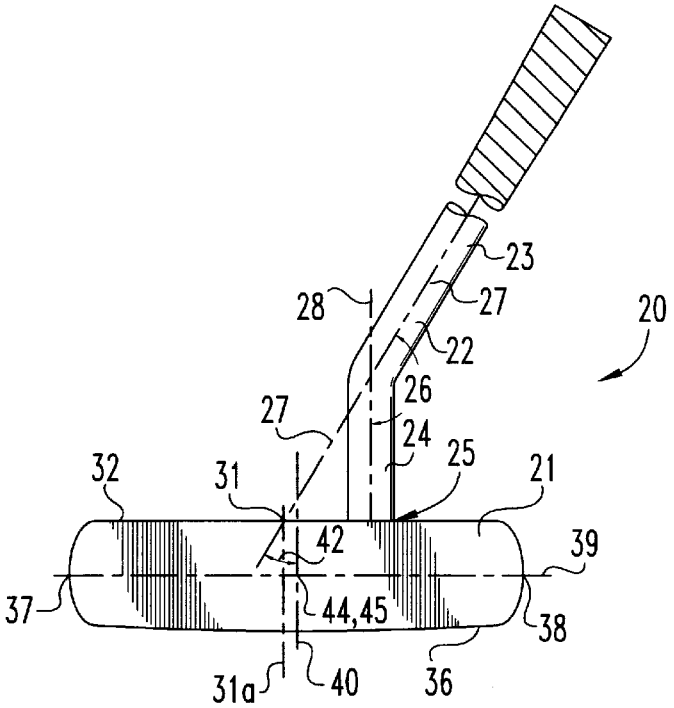
Fig. 1 (PRIOR ART)
FIG. 1 is a front elevational view of a prior art golf putter.
Figure 2:
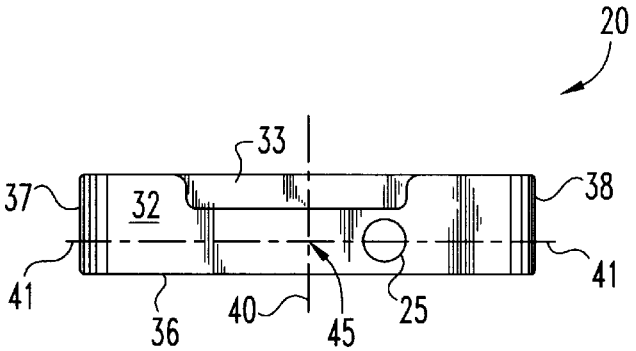
Fig. 2 (PRIOR ART)
FIG. 2 is a top plan view of the FIG. 1 golf putter.
Figure 3:
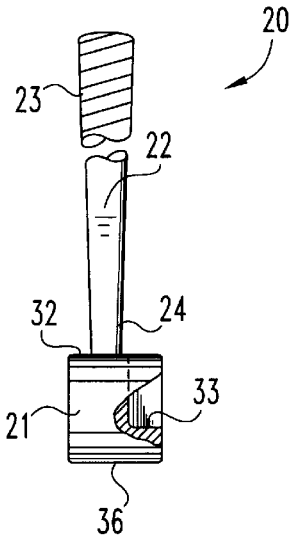
Fig. 3 (PRIOR ART)
FIG. 3 is an end elevational view of the FIG. 1 golf putter.
Figure 4:
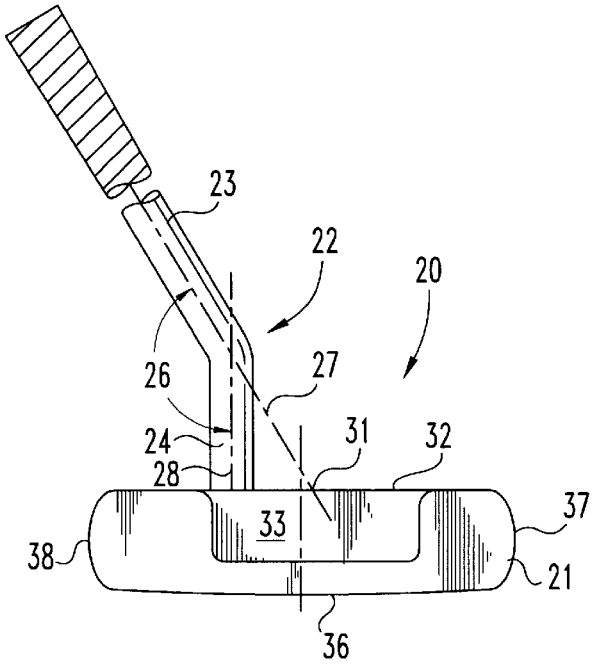
Fig. 4 (PRIOR ART)
FIG. 4 is a rear elevational view of the FIG. 1 golf putter.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring first to FIGS. 1–4, a golf putter 20 is disclosed which represents the prior art golf putter according to U.S. Pat. No. 5,228,332. The reference numerals which are used in FIGS. 1 through 4 coincide with the reference numerals of the '332 patent which is expressly incorporated by reference herein for its entire disclosure and drawings. The structural portions of putter 20 and the various geometric lines and planes include head 21, shaft 22, main body portion 23, neck 24, point of attachment 25, included angle 26, longitudinal axis 27, vertical axis 28, point of intersection 31, plane 31*a,* and top surface 32. The putter head 21 includes recess 33, bottom surface 36, outer end 37, and inner end 38. Geometric cutting planes 39, 40, and 41 define the center of gravity locations and establish the center of gravity point 45 for the entire putter head. Point 44 and distance 42 are also illustrated.

The prior art golf putter 20 which is described by the '332 patent has one specific location requirement and one specific structural feature which are changed in the design of the present invention golf putter. The one specific location which is changed is the attachment location 25 which in the '332 patent is centered on plane 41. The one specific structural feature which is changed is the substantially vertical shaft neck 24.

In the present invention, as diagrammatically illustrated by FIGS. 5 through 7C. golf putter 50 is designed so as to accommodate any number of different attachment locations (hosel socket locations) in the top surface 54 of the putter head 51 for the shaft neck 52. One such location 53 is illustrated in solid line form while a random sampling of alternative attachment locations 55–58 for the shaft neck 52 are illustrated in broken line form in FIG. 6. Regardless of the shape and geometry of putter head 51, the longitudinal axis 62 of shaft 63 still needs to be oriented and directed to extend through the putter head as taught by the '332 patent in order to establish a putter with a true balance.

Figure 7:
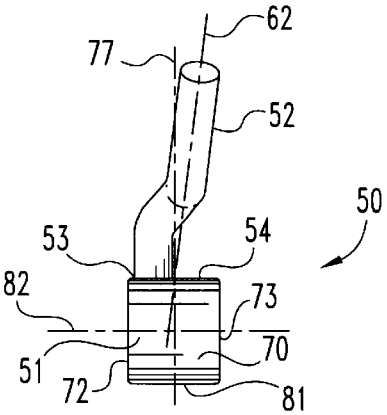
FIG. 7 is a partial, side elevational view of the FIG. 5 putter with a negative press.
Figure 7A:
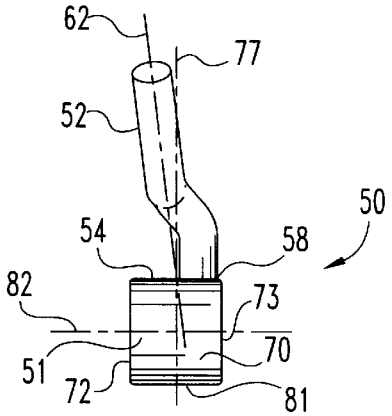
FIG. 7A is a partial, side elevational view of the FIG. 5 putter with the shaft neck at an alternate location and with a forward press according to the present invention.
Figure 7B:
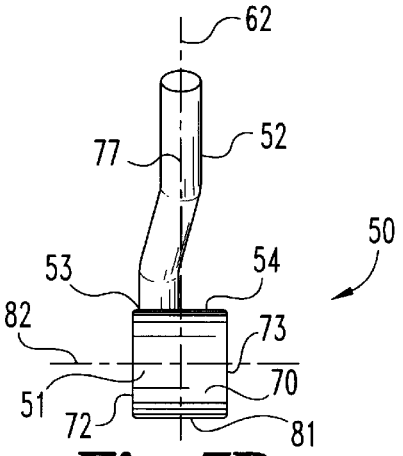
FIG. 7B is a partial, side elevational view of the FIG. 7 putter with no press.
Figure 7C:
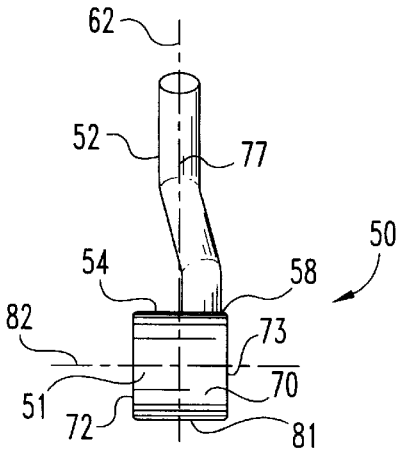
FIG. 7C is a partial, side elevational view of the FIG. 7A putter with no press.

Depending on the bends in the shaft and neck 52, the direction of the bore 74 into the putter head and ultimately the angle of orientation of the longitudinal axis 62 of the shaft 63, the overall putter is described as having a negative press (FIG. 7), a forward press (FIG. 7A), or no press (FIGS. 7B and 7C). FIG. 7B is based on the use of location 53, but changing the negative press of FIG. 7 to no press. FIG. 7C is based on the use of location 58, but changing the forward press of FIG. 7A to no press. "No press" as used herein means having neither a negative press nor a forward press, but in effect being in a neutral position.

As the attachment location changes, the shaft neck 52 is bent or otherwise shaped in order to bring the longitudinal axis 62 into the desired position. In effect, the shaft neck 52 is formed and bent to adjust or compensate for different attachment locations. Bending of the shaft neck is also performed to adjust or compensate for any angularity in the direction of the bore axis for bore 74, or any drilled hole or hosel located in the head in order to receive the shaft or, in this case, the shaft neck. The FIG. 7 drawing depicts the shaft neck 52 as positioned in location 53. An alternate shaft neck location is illustrated in FIG. 7A and this location coincides with location 58. A comparison of FIGS. 7 and 7A reveals how the shaft neck 52 is bent and oriented to achieve the desired balance according to the present invention. The shaft neck 52 has an initial bend 64 at the upper end of the neck just below the location where the neck 52 is joined to the shaft 63. Shaft 63 extends into grip 63*a*. A second bend 65 is located between the initial bend 64 and the top surface 54 of the golf putter head 51. Under normal or typical circumstances, these two bends will always be required. An optional third bend 67 may be located immediately adjacent to the top surface 54 of the putter head and would be included when the selected attachment location for the neck and shaft requires additional customizing. In fact, additional optional bends can be placed in neck 52 as might be required in order to properly orient the shaft axis.

As described, two bends will typically be required in the shaft neck 52, which extends from hosel location 53 (or one of the other locations) to the shaft. However, it is conceivable that a very precisely drilled hole for the hosel bore at a precise and exact angle could possibly eliminate the need for a second bend in the shaft neck. The concern with this approach is that there is virtually no margin for error and rework or remake of the club head is quite costly. It is substantially less expensive to rework bends in the shaft neck in order to achieve the desired shaft orientation, as described herein, than it is to rework or remake the club head.

Figure 5:
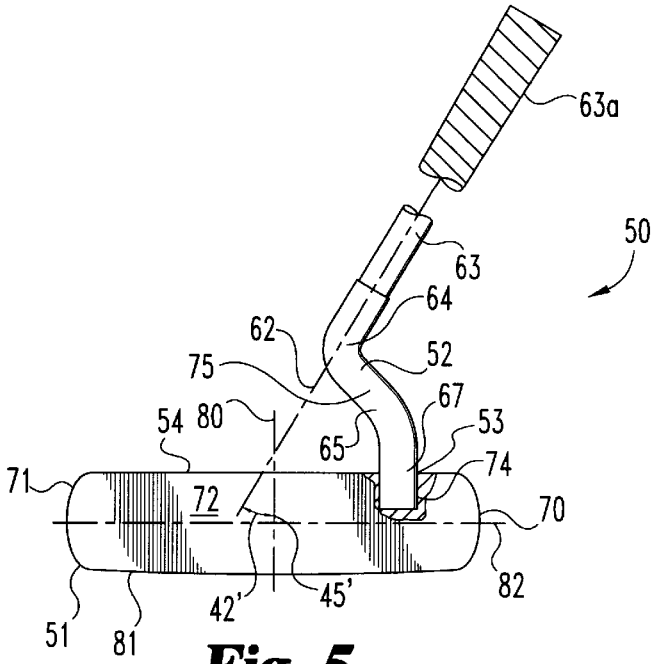
FIG. 5 is a partial, front elevational view of a golf putter according to a typical embodiment of the present invention.

It is to be understood that regardless of the attachment location, the neck is to be configured with various bends so that the longitudinal axis of shaft 63 extends through the top surface 54 of the putter head so as to pass through the geometric plane in FIGS. 5–7C which corresponds to geometric plane 41. In the FIG. 5 illustration the shaft axis 62 also passes beside the overall center of gravity 45' at a distance 42'. Therefore, shaft axis 62 passes between the overall center of gravity 45' and toe 71. However, the precise orientation of the shaft axis 62 as derived and taught by the present invention is for the axis 62 to intersect plane 41 (i.e., plane 77 in FIG. 6) at a location on the top surface 54 between plane 80 and toe 71. The overall center of gravity 45' is a point defined by the intersection of geometric planes 41, 80, and 82.

The specific geometry of each bend depends on the specific position of the attachment location (hosel) of the shaft neck 52 into the putter head 51, the angle, if any, of bore 74 and the desired press, negative, forward or none. (See FIGS. 7 through 7C). While virtually any combination of bends is possible and while there are no strict guidelines other than to achieve the correct axis line orientation, certain bend locations lend themselves to certain corrections. The initial bend 64 is preferably used to correct for the attachment location between the heel 70 and toe 71 of the putter head. The second bend 65 is preferably used to correct for the attachment location between the front, ball-striking surface 72, and the rear surface 73. These two bends create a shaft neck of a compound bend or compound curvature. The third (optional) bend 67 may be used to correct for an angularity in the orientation of the bore 74 which defines the attachment location 53, for example. Bore 74 is drilled down into the putter head 51 in order for the putter head to receive the shaft neck 52 at the selected attachment location. The length of portion 75 between the two bends 64 and 65 will also have an effect on the alignment of shaft axis 62 relative to its intersection with putter head 51.

In the FIG. 7 arrangement the attachment location 53 is substantially between surface 72 and plane 77 and thus the neck 52 must be bent back toward rear surface 73 in order to achieve proper axis 62 alignment. In the FIG. 7A arrangement, the attachment location 58 is substantially between surface 73 and plane 77 and thus the neck 52 must be bent forward toward surface 72 in order to achieve proper axis 62 alignment. FIGS. 7B and 7C are variations to FIGS. 7 and 7A, respectively, where there is neither a negative press nor a forward press.

In the illustrations of FIGS. 5–7C, the golf putters include three primary portions which have been identified as the putter head 51, shaft neck 52, and shaft 63. The hosel in golfing terminology is the socket or bore in the putter head into which the shaft is inserted and secured. This is typical construction when the shaft 63 and shaft neck 52 are effectively configured as a one-piece unit (integral) such that the "shaft" is inserted directly into the hosel for final assembly to the club head.

Figure 8:
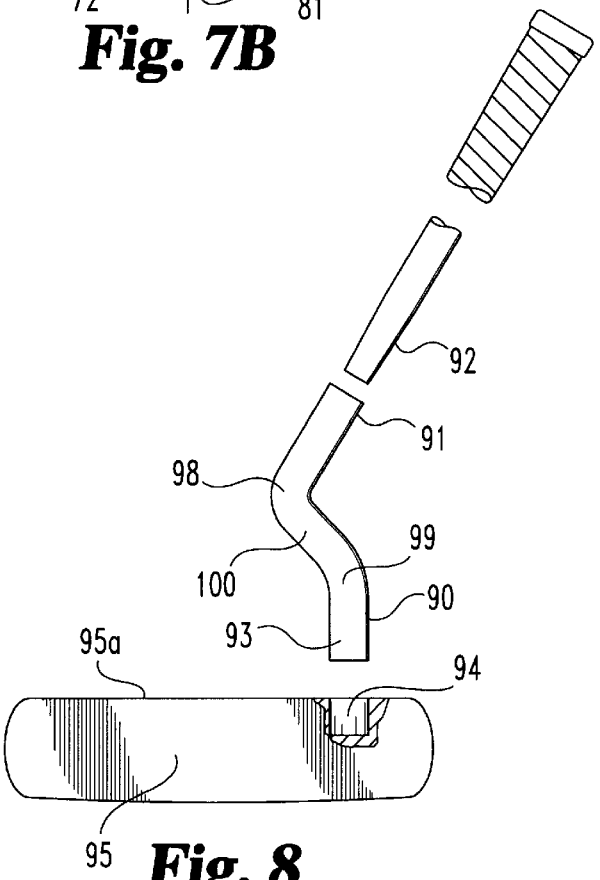
FIG. 8 is a front elevational view of a hosel adapter according to the present invention.
Figure 9:
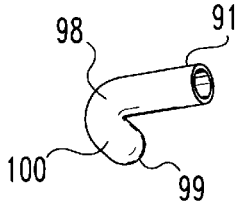
FIG. 9 is a top plan view of the FIG. 8 hosel adapter.
Figure 10:
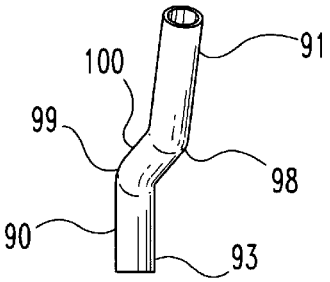
FIG. 10 is a side elevational view of the FIG. 8 hosel adapter.

An alternative to this typical construction approach is illustrated in FIGS. 8–10 wherein hosel adapter 90 is configured so as to match the geometry of shaft neck 52. Hosel adapter 90 includes a hollow female end 91 for receipt of the end of shaft 92 and a male end 93 for insertion into the hosel socket 94 of the putter head 95. Alternatively, end 91 could be constructed and arranged to fit within a hollow shaft end, but this would typically require firther modifications to the shaft. Normally the end of the straight portion of the shaft at the junction with the shaft neck, such as 52, will have a cylindrical shape, slightly tapered, so as to decrease in diameter in the direction of the putter head. This shaft end can be easily received within the hollow end 91 and securely joined to effectively create a one-piece assembly. End 93 is to be anchored into socket 94 and this completes the assembly of the golf putter. If the attachment location (hosel 94) in the putter head 95 for the hosel adapter 90 is alternatively configured as a male stem extending above the top surface 95*a* of the putter head, then the male end 93 will be reconfigured as a hollow female end to receive the stem.

While hosel adapter 90 represents one option for the manufacturing of new golf putters according to the present invention, it also and preferably represents a unique option for repair of existing golf putters which were not originally designed according to the present invention. Since the hosel socket 94 in the top surface 95*a* of putter head 95 according to the present invention can be placed at virtually any location, it is a relatively simple task to modify existing golf putters to incorporate the teachings of the present invention. The first step in the modification is to remove the old shaft from the putter head hosel and then shorten the shaft. The hosel socket needs to be prepared for receipt of the adapter end 93. Next, a hosel adapter 90 is selected and the two bends 98 and 99 are configured, based on the hosel location and any hosel bore angularity so as to achieve the correct and desired shaft axis 62 alignment relative to the putter head geometry and weight distribution as described and taught by the present invention. The geometry and the length of separating portion 100 which is located between bends 98 and 99 can also influence the alignment of shaft axis 62. Accordingly, this portion 100, based on its geometry and length, will influence the precise geometry of bends 98 and 99 and vice versa.

The shortened shaft is assembled to end 91 and secured in position. Next, end 93 is assembled to the putter head 95. While an adhesive is used to securely anchor the adapter 90 to or into the putter head 95, a final alignment and balancing step, as described hereinafter, is performed before the adhesive sets up.

Figure 6:
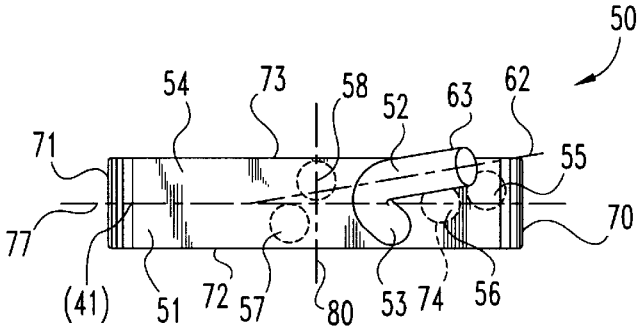
FIG. 6 is a partial, top plan view of the FIG. 5 golf putter.

In the '332 patent, the attachment location 25 is positioned (centered) relative to geometric plane 41, such that the plane 41 passes through the center of the receiving bore. Further, the attachment location is between the toe to heel center of gravity plane 40 and the heel of the putter head. In the present invention, the attachment location is not restricted and is actually located off of the geometric plane 77 which is the center of gravity dividing plane between the ball-striking surface 72 and the rear surface 73. In the FIG. 6 illustration, planes 41 and 77 are coincident planes.

As explained relative to the FIG. 8 illustration of the '332 patent, the front-to-rear center of gravity geometric plane and the toe-to-heel center of gravity geometric plane have a line intersection. The shaft axis 27 of the '332 patent passes through this line intersection and the shaft axis extends past the overall center of gravity point 47 at an optimum distance 46. The same relationships are retained and made part of the present invention.

In manufacturing the golf putter 50 according to the present invention, the first step is to decide on the general shape, size, and geometry of the putter head 51. The next step is to examine the putter head and determine the location of at least two of the three available center of mass, or center of gravity, geometric dividing planes. While all three dividing planes were determined with regard to the prior art putter of the '332 patent, the two dividing planes which are critical to the present invention is the center of gravity dividing plane 80 which is positioned between the toe 71 and heel 70. The other center of gravity, or center of mass, dividing plane which is important to the present invention is plane 77 which is located between the front and rear surfaces, 72 and 73, respectively. If the third center of gravity dividing plane 82 is to be determined, it is located between the top surface 54 and the bottom surface 81. The intersection of these three planes is the overall center of gravity or center of mass point 45'.

Once the locations of geometric dividing planes 77 and 80 are determined, the next step is to select an attachment location for the neck 52. It is to be assumed at this point that the neck and shaft 63 have been attached to each other in a secure and integral fashion. While the neck 52 may begin as a substantially straight member, it is to be bent in accordance with the present invention so as to properly orient and align the longitudinal axis 62 of shaft 63. By not attaching the neck 52 to the putter head at a location which is centered on dividing plane 77, the present invention can then be practiced. The objective is to bend the neck 52 in order to achieve a particular orientation of axis 62. The neck is also able to be rotated within the drilled bore in the top surface 54 of the putter head as a further step to facilitate the orienting and directing of the longitudinal axis 62 along the desired path. According to the present invention, the desired path for axis 62 is one which intersects plane 77 at a location on top surface 54 which is between plane 80 and toe 71. The path for axis 62 will accordingly extend past point 45' at a distance 42'. The orienting of shaft axis 62 so as to intersect plane 77 somewhere between plane 80 and toe 71 provides the true balance to the golf putter of the present invention.

The final step in the manufacturing of golf putter 50 is virtually the same as that taught by the '332 patent. A flat and level horizontal surface is used for checking the true balance of the golf putter and rotating the putter head slightly relative to the shaft or hosel adapter, if needed, in order to correct for any minor imbalance caused by slight tolerance variations. This fine-tuning step is performed before the adhesive which secures the head and shaft (or adapter) together fully sets up.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of manufacturing a golf putter with a true balance comprising the following steps:

providing a golf putter head having a top surface, a toe and a heel and a desired size and shape;

providing a golf putter shaft having a longitudinal axis;

providing a neck portion;

attaching the neck portion to the shaft;

determining front-to-rear and toe-to-heel center of gravity planes for the golf putter head;

selecting an attachment location for the neck portion to said golf putter head which is spaced apart from said front-to-rear center of gravity plane;

bending said neck portion relative to said attachment location such that the longitudinal axis extends to intersect the front-to-rear center of gravity plane at a location on said top surface which is between the toe-to-heel center of gravity plane and the toe of said golf putter head;

attaching the neck portion to the golf putter head; and adjusting said golf putter head and said golf putter shaft relative to each other by rotating said neck portion within said putter head based upon the balance of the putter revealed by placing the putter on a substantially flat, substantially horizontal surface.

2. The method of claim 1 wherein said golf putter head includes a ball-striking surface and a rear surface and said attachment location is between said ball-striking surface and said front-to-rear center of gravity plane and the step of bending the neck portion includes bending the neck portion toward said rear surface.

3. The method of claim 1 wherein said golf putter head includes a ball-striking surface and a rear surface and said attachment location is between said front-to-rear center of gravity plane and said rear surface and the step of bending the neck portion includes bending the neck portion toward said ball-striking surface.

4. A method of manufacturing a golf putter with a true balance comprising the following steps:

providing a golf putter head having a top surface, a toe and a heel and a desired size and shape;

providing a golf putter shaft having a longitudinal axis and a neck portion;

determining front-to-rear and toe-to-heel center of gravity planes for the golf putter head;

selecting an attachment location for the neck portion to said golf putter head which is spaced apart from said front-to-rear center of gravity plane;

bending said neck portion relative to said attachment location such that the longitudinal axis extends to intersect the front-to-rear center of gravity plane at a location on said top surface which is between the toe-to-heel center of gravity plane and the toe of said golf putter head;

attaching the neck portion to the golf putter head; and adjusting said golf putter head and said golf putter shaft relative to each other by rotating said neck portion within said putter head based upon the balance of the putter revealed by placing the putter on a substantially flat, substantially horizontal surface.

5. The method of claim 4 wherein said golf putter head includes a ball-striking surface and a rear surface and said attachment location is between said ball-striking surface and said front-to-rear center of gravity plane and the step of bending the neck portion includes bending the neck portion toward said rear surface.

6. The method of claim 4 wherein said golf putter head includes a ball-striking surface and a rear surface and said attachment location is between said front-to-rear center of gravity plane and said rear surface and the step of bending the neck portion includes bending the neck portion toward said ball-striking surface.

7. A golf putter comprising:

a head having a top surface with a selected attachment location, a toe and a heel and a predetermined size and shape, said head having a front-to-rear center of gravity plane and a toe-to-heel center of gravity plane, said selected attachment location being spaced apart from said front-to-rear center of gravity plane; and a shaft having a longitudinal axis and including a neck portion, said neck portion being constructed and arranged with two bends spaced apart from each other by a separating portion, said neck portion being securely assembled to said head at said attachment location, said two bends having a bend geometry such that said longitudinal axis extends to intersect the front-to-rear center of gravity plane at a location on said top surface which is between the toe-to-heel center of gravity plane and the toe of said head.

8. The golf putter of claim 7 wherein said head includes a ball-striking surface and a rear surface and said attachment location is positioned between said ball-striking surface and said front-to-rear center of gravity plane.

9. The golf putter of claim 7 wherein said golf putter head includes a ball-striking surface and a rear surface and said attachment location is between said front-to-rear center of gravity plane and said rear surface and the step of bending the neck portion includes bending the neck portion toward said ball-striking surface.

10. A golf putter comprising:

a head having a top surface with a selected attachment location, a toe and a heel and a predetermined size and shape, said head having a front-to-rear center of gravity plane and a toe-to-heel center of gravity plane, said selected attachment location being spaced apart from said front-to-rear center of gravity plane;

a shaft having a longitudinal axis; and a connecting portion joined at a first end to said shaft and joined at a second, opposite end to said head at said attachment location, said connecting portion being constructed and arranged with two bends spaced apart from each other by a separating portion, said two bends having a bend geometry such that said longitudinal axis extends to intersect the front-to rear center of gravity plane at a location on said top surface which is between the toe-to-heel center of gravity plane and the toe of said head.

11. The golf putter of claim 10 wherein said head includes a ball-striking surface and a rear surface and said attachment location is positioned between said ball-striking surface and said front-to-rear center of gravity plane.

12. The golf putter of claim 10 wherein said golf putter head includes a ball-striking surface and a rear surface and said attachment location is between said front-to-rear center of gravity plane and said rear surface and the step of bending the connecting portion includes bending the connecting portion toward said ball-striking surface.

13. A method of manufacturing a golf putter with a true balance comprising the following steps:

providing a golf putter head having a top surface, a toe and a heel and a desired size and shape;

providing a golf putter shaft having a longitudinal axis;

providing a neck portion;

attaching the neck portion to the shaft;

determining front-to-rear, toe-to-heel, and top-to-bottom center of gravity planes for the golf putter head, the intersection of said three center of gravity planes defining a center of gravity point which is interior to said golf putter head;

selecting an attachment location for the neck portion to said golf putter head which is spaced apart from said front-to-rear center of gravity plane;

bending said neck portion relative to said attachment location such that the longitudinal axis extends to intersect the front-to-rear center of gravity plane at a location on said top surface whereat extension of said longitudinal axis through the golf putter head passes between said center of gravity point and the toe of said golf putter head;

attaching the neck portion to the golf putter head; and adjusting said golf putter head and said golf putter shaft relative to each other by rotating said neck portion within said putter head based upon the balance of the putter revealed by placing the putter on a substantially flat, substantially horizontal surface.

14. A method of manufacturing a golf putter with a true balance comprising the following steps:

providing a golf putter head having a top surface, a toe and a heel and a desired size and shape;

providing a golf putter shaft having a longitudinal axis and a neck portion;

determining front-to-rear, toe-to-heel, and top-to-bottom center of gravity planes for the golf putter head, the intersection of said three center of gravity planes defining a center of gravity point which is interior to said golf putter head;

selecting an attachment location for the neck portion to said golf putter head which is spaced apart from said front-to-rear center of gravity plane;

bending said neck portion relative to said attachment location such that the longitudinal axis extends to intersect the front-to-rear center of gravity plane at a location on said top surface whereat extension of said longitudinal axis through the golf putter head passes between said center of gravity point and the toe of said golf putter head;

attaching the neck portion to the golf putter head; and adjusting said golf putter head and said golf putter shaft relative to each other by rotating said neck portion within said putter head based upon the balance of the putter revealed by placing the putter on a substantially flat, substantially horizontal surface.

15. A golf putter comprising:

a head having a top surface with a selected attachment location, a toe and a heel and a predetermined size and shape, said head having a front-to-rear center of gravity plane, a toe-to-heel center of gravity plane, and a top-to-bottom center of gravity plane, the intersection of said three center of gravity planes defining a center of gravity point interior to said head; and a shaft having a longitudinal axis and including a neck portion, said neck portion being constructed and arranged with two bends spaced apart from each other by a separating portion, said neck portion being securely assembled to said head at said attachment location, said two bends having a bend geometry such that said longitudinal axis extends to intersect the front-to-rear center of gravity plane at a location on said top surface whereat extension of said longitudinal axis through the head passes between said center of gravity point and the toe of said head.

16. A golf putter comprising:

a head having a top surface with a selected attachment location, a toe and a heel and a predetermined size and shape, said head having a front-to-rear center of gravity plane and a toe-to-heel center of gravity plane, said selected attachment location being spaced apart from said front-to-rear center of gravity plane at a location on said top surface whereat extension of said longitudinal axis through the head passes between said center of gravity point and the toe of said head;

a shaft having a longitudinal axis; and a connecting portion joined at a first end to said shaft and joined at a second, opposite end to said head at said attachment location, said connecting portion being constructed and arranged with two bends spaced apart from each other by a separating portion, said two bends having a bend geometry such that said longitudinal axis extends to intersect the front-to rear center of gravity plane at a location on said top surface which is between the toe-to-heel center of gravity plane and the toe of said head.

* * * * *

UNITED STATES PATENT AND TRADEMARK OFFICE
CERTIFICATE OF CORRECTION

PATENT NO : 6,083,113

DATED : July 4, 2000

INVENTOR(S) : Mark A. Bernhardt

It is certified that an error appears in the above-identified patent and that said Letters Patent are hereby corrected as shown below:

In Col. 6, at line 49, replace "firther" with -- further -- .

In Col. 7, at line 10, replace "aligrnent" with -- alignment --.

Signed and Sealed this

Third Day of April, 2001

*Attest:*

Nicholas P. Godici

NICHOLAS P. GODICI

*Attesting Officer*

*Acting Director of the United States Patent and Trademark Office*